US011211730B2

(12) United States Patent
Shirai et al.

(10) Patent No.: US 11,211,730 B2
(45) Date of Patent: Dec. 28, 2021

(54) CONNECTOR TERMINAL, ELECTRICAL WIRE WITH TERMINAL, AND TERMINAL PAIR

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventors: Yoshimasa Shirai, Mie (JP); Kingo Furukawa, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/867,602

(22) Filed: May 6, 2020

(65) Prior Publication Data

US 2020/0366020 A1 Nov. 19, 2020

(30) Foreign Application Priority Data

May 16, 2019 (JP) ..... JP2019-093257

(51) Int. Cl.
*H01R 13/03* (2006.01)
*H01R 4/18* (2006.01)

(52) U.S. Cl.
CPC ..... *H01R 13/03* (2013.01); *H01R 4/183* (2013.01)

(58) Field of Classification Search
CPC ..... H01R 13/03; H01R 4/183
USPC ..... 439/887
See application file for complete search history.

(56) References Cited

U.S. PATENT DOCUMENTS 5,235,743 A * 8/1993 Endo ..... H01R 13/03 29/874
5,892,424 A * 4/1999 Yamamoto ..... H01H 1/0201 335/151
6,116,970 A * 9/2000 Yamamoto ..... H01R 13/113 439/852
6,254,979 B1 * 7/2001 Drew ..... B32B 15/01 205/109
6,316,832 B1 * 11/2001 Tsuzuki ..... H01L 31/0508 257/747

(Continued)

FOREIGN PATENT DOCUMENTS

JP 2008-169408 A 7/2008
JP 2016-166396 A 9/2016
JP 2019044274 * 3/2019 ..... H01H 1/025

*Primary Examiner* — Peter G Leigh
(74) *Attorney, Agent, or Firm* — Abelman, Frayne & Schwab

(57) ABSTRACT

An object of the invention is to provide a connector terminal in which an outermost layer is not susceptible to wear due to repeated sliding, an electrical wire with terminal and a terminal pair. The connector terminal includes a base material and an outermost layer provided on at least part of the base material. A constituent material of the outermost layer contains 98 mass % or more of Ag, and a Vickers hardness of the outermost layer with a measuring load of 0.1 N is from 115 HV to 160 HV inclusive.

9 Claims, 6 Drawing Sheets

(56) References Cited

U.S. PATENT DOCUMENTS

| | | | | |
|---|---|---|---|---|
| 7,856,712 | B2 * | 12/2010 | Busies | H01R 43/16 29/882 |
| 8,104,173 | B2 * | 1/2012 | Heacox | H01R 43/16 29/874 |
| 9,114,594 | B2 * | 8/2015 | Zhang-Beglinger | C22C 5/06 |
| 9,401,556 | B2 * | 7/2016 | Tsugawa | H01R 13/26 |
| 9,680,246 | B2 * | 6/2017 | Takahashi | H01R 13/03 |
| 9,692,162 | B2 * | 6/2017 | Sunaga | C25D 7/00 |
| 9,755,343 | B2 * | 9/2017 | Sunaga | C23C 14/165 |
| 2003/0091855 | A1 * | 5/2003 | Tanaka | C23C 28/023 428/647 |
| 2003/0186597 | A1 * | 10/2003 | Suzuki | H01R 13/03 439/886 |
| 2010/0186993 | A1 * | 7/2010 | Yamaguchi | B32B 15/018 174/126.2 |
| 2015/0047879 | A1 * | 2/2015 | Shibuya | C22C 19/03 174/126.2 |
| 2016/0172069 | A1 * | 6/2016 | Sumiya | B32B 15/018 428/673 |
| 2016/0348260 | A1 * | 12/2016 | Takahashi | C25D 5/48 |
| 2017/0162969 | A1 * | 6/2017 | Jou | H01R 13/03 |
| 2017/0271800 | A1 * | 9/2017 | Wagman | H01R 13/40 |
| 2017/0370015 | A1 * | 12/2017 | Sadamori | B32B 15/018 |
| 2018/0212350 | A1 * | 7/2018 | Tamura | C25D 3/64 |

* cited by examiner

CONNECTOR TERMINAL, ELECTRICAL WIRE WITH TERMINAL, AND TERMINAL PAIR

CROSS-REFERENCE TO RELATED APPLICATIONS

This application is based on and claims priority from Japanese Patent Application No. 2019-093257, filed on May 16, 2019, with the Japan Patent Office, the disclosure of which is incorporated herein in its entirety by reference.

TECHNICAL FIELD

This disclosure relates to a connector terminal, an electrical wire with terminal, and a terminal pair.

BACKGROUND

Conventionally, plated terminals provided with a plating layer are utilized on the surface of a base material made of copper or a copper-base alloy, as connector terminals that are attached to the ends of electrical wires. Japanese Patent Laid-open Publication Nos. 2008-169408 and 2016-166396 disclose silver plating layers as plating layers. Silver is highly conductive. Thus, the connection resistance of a plated terminal provided with a silver plating layer on the outermost surface tends to be low.

The outermost layer is desirably not susceptible to wear due to repeated sliding on the above-mentioned plated terminal.

A slight gap is formed between the connecting place of a plated female terminal and a plated male terminal, due to manufacturing tolerance of the terminals and the like. The contact place of both terminals can slide due to this gap. In the case of utilizing such plated terminals as an in-vehicle component, for example, it is conceivable that the plating layer forming the outermost surface of the plated female terminal and the plating layer forming the outermost surface of the plated male terminal slide due to vibration of the car. This sliding is an action such as repeatedly moving a comparatively short distance in a state where a comparatively large load is applied to both terminals. The plating layers are gradually worn down by this repeated sliding. The connection resistance increases if the plating layers are eliminated. Accordingly, plated terminals in which the plating layer forming the outermost surface is not worn down and eliminated, that is, plated terminals in which this plating layer is not susceptible to wear, even in the case where the above-mentioned repeated sliding occurs, are desirable.

In view of this, one object of the disclosure is to provide a connector terminal in which the outermost layer is not susceptible to wear due to repeated sliding. Also, another object of the disclosure is to provide an electrical wire with terminal and a terminal pair in which the outermost layer of a connector terminal is not susceptible to wear due to repeated sliding.

SUMMARY

A connector terminal of the disclosure includes: a base material; and an outermost layer provided on at least part of the base material, in which a constituent material of the outermost layer contains 98 mass % or more of Ag, and a Vickers hardness of the outermost layer with a measuring load of 0.1 N is 115 HV to 160 HV inclusive.

An electrical wire with terminal of the disclosure includes: the connector terminal of the disclosure; and an electrical wire to which the connector terminal is attached.

A terminal pair of the disclosure includes: a male terminal and a female terminal, an which at least one of the male terminal and the female terminal is constituted by the connector terminal of the disclosure, and a difference between the Vickers hardness of the outermost layer in the male terminal and the Vickers hardness of the outermost layer in the female terminal is less than 10 HV.

In the connector terminal of the disclosure, the electrical wire with terminal of the disclosure and the terminal pair of the disclosure, the outermost layer of the connector terminal is not susceptible to wear due to repeated sliding.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
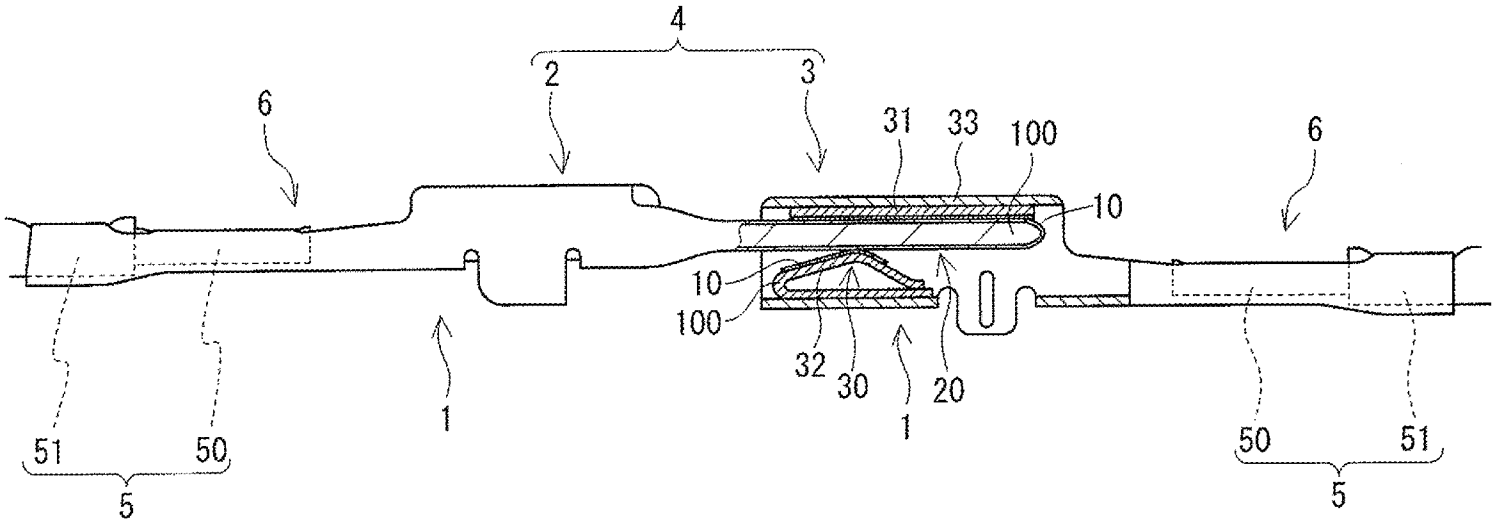
FIG. 1 is a schematic configuration diagram showing a state in which electrical wires with terminals that includes a connector terminal of an embodiment are connected.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

[Description of Embodiments of the Disclosure]

Initially, embodiments of the disclosure will be enumerated and described.

(1) A connector terminal according to one mode of the disclosure includes: a base material; and an outermost layer provided on at least part of the base material, in which a constituent material of the outermost layer contains 98 mass % or more of Ag, and a Vickers hardness of the outermost layer with a measuring load of 0.1 N is 115 HV to 160 HV inclusive.

An outermost layer whose Vickers hardness satisfies the above-mentioned specific range can be said to be not too hard and not too soft. Thus, the above outermost layer is not susceptible to wear, even if the use environment of the connector terminal of the disclosure is an environment where sliding a comparatively short distance occurs repeatedly in a state where a comparatively large load is applied to the connector terminal (refer to the test examples described below). Accordingly, the connector terminal of the disclosure is readily maintained in a low resistance connection state for an extended period, due to the outermost layer whose main component is Ag.

(2) In an example of the connector terminal of the disclosure, the outermost layer has a thickness from 1 μm or more to less than 10 μm.

The above configuration, in addition to readily maintaining the outermost layer for an extended period, also exhibits excellent manufacturability in terms of having a short plating time, in the case of utilizing a plating method in formation of the outermost layer. Material costs are also readily lowered.

(3) In an example of the connector terminal of the disclosure, the constituent material of the base material is copper or a copper-base alloy, the connector terminal includes an intermediate layer between the base material and the outermost layer, and the intermediate layer includes a layer made of nickel or a nickel-base alloy.

The above configuration is able to reduce diffusion of the copper component included in the base material into the outermost layer, due to the intermediate layer whose main component is nickel. Accordingly, the above configuration is able to favorably construct a low resistance connection structure, due to the outermost layer whose main component is Ag.

(4) In an example of the connector terminal of the disclosure, an average value of a coefficient of friction from 90 cycles to 100 cycles is 1.5 or more, when 100 cycles of a repeated slide test are performed under conditions where a contact load is 5 N, a slide distance is 0.2 mm, and a slide speed is 0.4 mm/sec.

The above conditions can be said to be conditions (hereinafter, may be referred to as specific conditions) in which sliding a comparatively short distance occurs repeatedly in a state where a comparatively large load is applied to the connector terminal. The above configuration can be said to stably have a high coefficient of friction in the late cycles. The high coefficient of friction is thought to originate in the Ag of the outermost layer. Such a configuration readily maintains the outermost layer, even if subjected to repeated sliding such as the specific conditions.

(5) In an example of the connector terminal of the disclosure, a ratio $y_a/x$ of an average value $y_a$ of the coefficient of friction from 90 cycles to 100 cycles to a maximum value x of the coefficient of friction is 0.7 or more, when 100 cycles of the repeated slide test are performed under conditions where the contact load is 5 N, the slide distance is 0.2 mm, and the slide speed is 0.4 mm/sec.

The above configuration can be said to have a high coefficient of friction even in the late cycles, due to the difference between the coefficient of friction in the late cycles and the maximum value of the coefficient of friction being small. The high coefficient of friction is thought to originate in the Ag of the outermost layer. Such a configuration readily maintains the outermost layer, even if subjected to repeated sliding such as the specific conditions.

(6) In an example of the connector terminal of the disclosure, the coefficient of friction of a 100th cycle is 1.5 or more, when 100 cycles of the repeated slide test are performed under conditions where the contact load is 5 N, the slide distance is 0.2 mm, and the slide speed is 0.4 mm/sec.

The above configuration can be said to have a high coefficient of friction even in the 100th cycle. The high coefficient of friction is thought to originate in the Ag of the outermost layer. Such a configuration readily maintains the outermost layer, even if subjected to repeated sliding such as the specific conditions.

(7) In an example of the connector terminal of the disclosure, a ratio $y_{100}/x$ of a coefficient of friction $y_{100}$ of the 100th cycle to the maximum value x of the coefficient of friction is 0.7 or more, when 100 cycles of the repeated slide test are performed under conditions where the contact load is 5 N, the slide distance is 0.2 mm, and the slide speed is 0.4 mm/sec.

The above configuration can be said to have a high coefficient of friction even in the 100th cycle, due to the difference between the coefficient of friction of the 100th cycle and the maximum value of the coefficient of friction being small. The high coefficient of friction is thought to originate in the Ag of the outermost layer. Such a configuration readily maintains the outermost layer, even if subjected to repeated sliding such as the specific conditions.

(8) In an example of the connector terminal of the disclosure, a difference (x−y) between the maximum value x of the coefficient of friction and the average value y of the coefficient of friction for 100 cycles is 0.5 or less, when 100 cycles of the repeated slide test are performed under conditions where the contact load is 5 N, the slide distance is 0.2 mm, and the slide speed is 0.4 mm/sec.

The above configuration can be said to have a high coefficient of friction from the early cycles to the late cycles, due to the difference between the average coefficient of friction for 100 cycles and the maximum value of the coefficient of friction being small. The high coefficient of friction is thought to originate in the Ag of the outermost layer. Such a configuration readily maintains the outermost layer, even if subjected to repeated sliding such as the specific conditions.

(9) The electrical wire with terminal according to one mode of the disclosure includes: the connector terminal according to any one of the above (1) to (8); and an electrical wire to which the connector terminal is attached.

The outermost layer of the connector terminal is not susceptible to wear, even if the use environment of the electrical wire with terminal of the disclosure is an environment where sliding a comparatively short distance occurs repeatedly in a state where a comparatively large load is applied to the connector terminal. Accordingly, the electrical wire with terminal of the disclosure maintains a low-resistance connection state for an extended period, due to the outermost layer whose main component is Ag.

(10) The terminal pair according to one mode of the disclosure includes: a male terminal and a female terminal, at least one of the male terminal and the female terminal is constituted by the connector terminal according to any one of the above (1) to (8), and a difference between the Vickers hardness of the outermost layer in the male terminal and the Vickers hardness of the outermost layer in the female terminal is less than 10 HV.

The outermost layer of the male terminal or the female terminal constituted by the connector terminal of the disclosure is not susceptible to wear, even if the use environment of the terminal pair of the disclosure is an environment where sliding a comparatively short distance occurs repeatedly in a state where a comparatively large load is applied to the male terminal and the female terminal. Accordingly, the terminal pair of the disclosure readily maintains a low resistance state for an extended period, due to the outermost layer whose main component is Ag.

[Detailed Description of Embodiments of the Disclosure]

Hereinafter, embodiments of the disclosure will be specifically described, with reference to drawings. The same reference numerals throughout the drawings denote the same elements.

[Connector Terminal]

Figure 2:
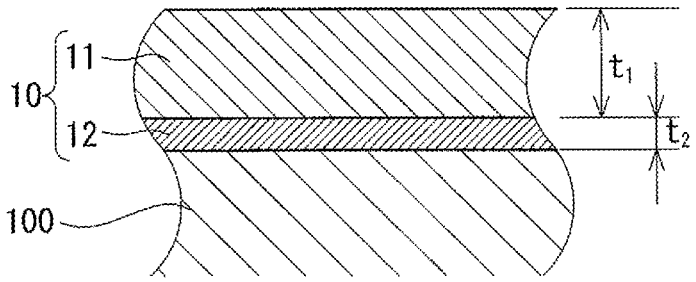
FIG. 2 is an enlarged schematic cross-sectional view showing a covering layer provided in the connector terminal of an embodiment.
Figure 3:
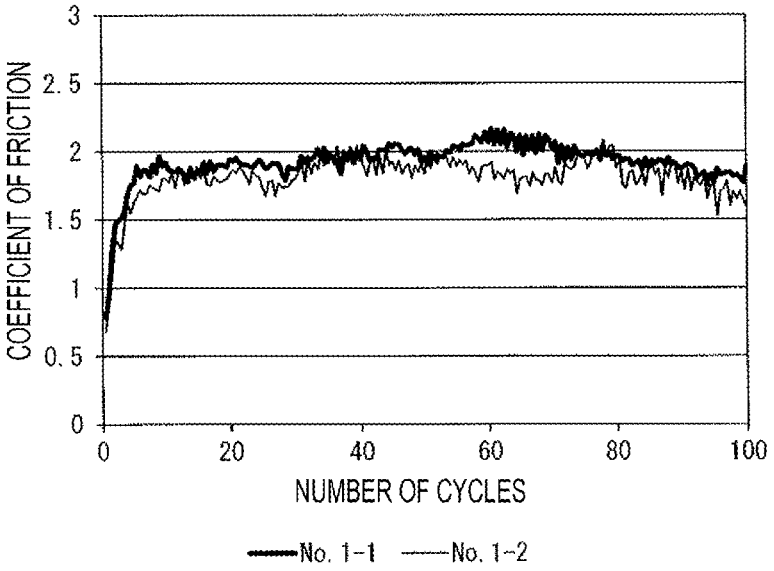
FIG. 3 is a graph showing the results of a slide test performed in a test example 1, and shows the relationship between the number of cycles and the coefficient of friction for a covering member of a test sample No. 1.
Figure 4:
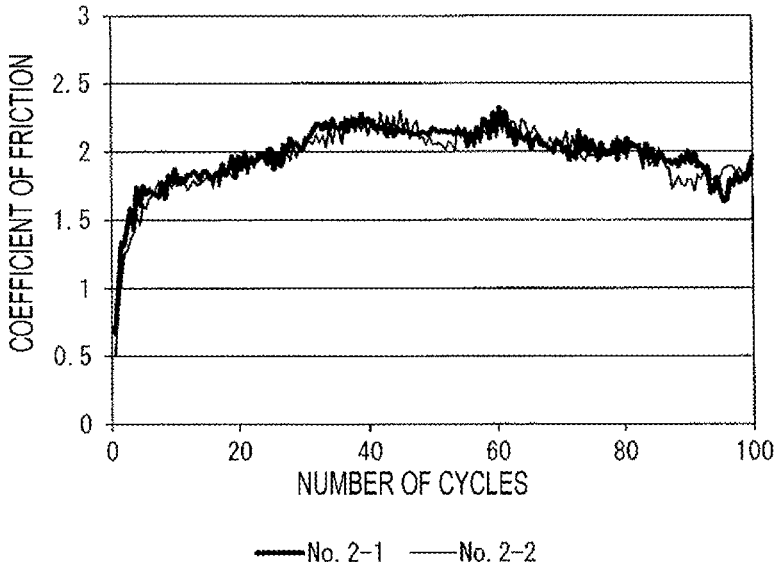
FIG. 4 is a graph showing the results of the slide test performed in the test example 1, and shows the relationship between the number of cycles and the coefficient of friction for the covering member of a test sample No. 2.
Figure 5:
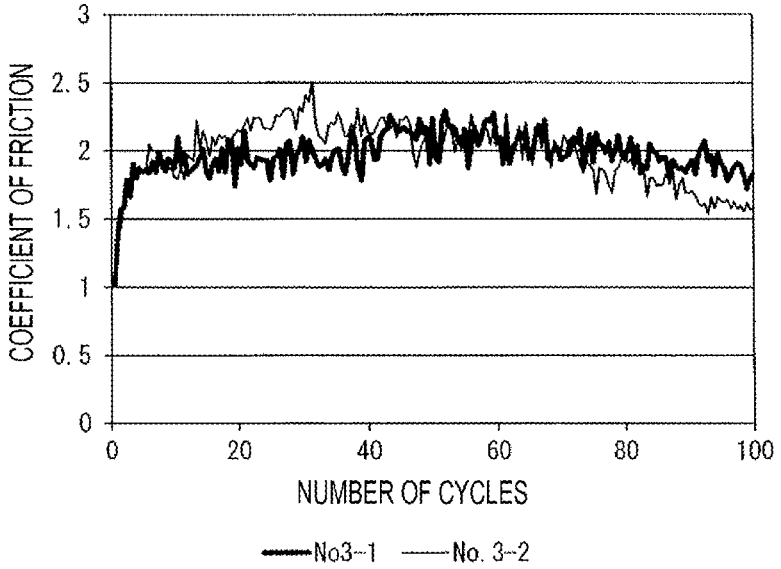
FIG. 5 is a graph showing the results of the slide test performed in the test example 1, and shows the relationship between the number of cycles and the coefficient of friction for the covering member of a test sample No. 3.

The following description will focus on a connector terminal 1 of an embodiment, with reference to FIGS. 1 and 2.

FIG. 1 is a plan view of a state where a male terminal 2 and a female terminal 3 are connected as seen in a direction (vertical direction on the page in FIG. 1) orthogonal to an axial direction (left-right direction on the page in FIG. 1) of an electrical wire 5. The connection place of the male terminal 2 and the female terminal 3 is partially shown in cross-section. This cross-section shows a state where a tube part 33 of the female terminal 3 and an elastic contact part 30 inside the tube part 33 have been cut, in a plane in the axial direction of the electrical wire 5. Also, FIG. 1 shows a covering layer 10 in an exaggerated manner. As for the actual thickness of the covering layer 10, refer to the Thickness section below.

(Summary)

The connector terminal 1 of the embodiment is, typically, a conductive member that is used in electrically connecting electrical wires 5. The connector terminal 1 is provided with a place for connecting with a mating member (another connector terminal) at least at one end thereof. FIG. 1 illustrates a tab part 20 and the elastic contact part 30 as the connection place with the mating member.

The connector terminal 1 of the embodiment is provided with a base material 100 and a covering layer 10. The covering layer 10 is provided on at least part of the base material 100, and covers the surface of the base material 100. The covering layer 10 includes an outermost layer 11 (FIG. 2). In particular, in the connector terminal 1 of the embodiment, the outermost layer 11 is constituted by a metal including 98 mass % or more of Ag and whose main component is Ag. Also, the Vickers hardness of the outermost layer 11 is from 115 HV to 160 HV inclusive. The load at the time of measuring the Vickers hardness of the outermost layer 11 is given as 0.1 N (≈10 gf).

Hereinafter, first, the basic configuration of the connector terminal 1 and the base material 100 will be briefly described, and, thereafter, the covering layer 10 including the outermost layer 11 will be described in detail.

(Basic Configuration)

As a typical example, the connector terminal 1 is attached to the end of the electrical wire 5 as shown in FIG. 1. FIG. 1 shows the male terminal 2 as an example of such a connector terminal 1, and the female terminal 3 as another example. This connector terminal 1 is provided with a place for electrically connecting to a mating member on one end side, and is provided with a place for attaching the electrical wire 5 on the other end side. Typically, the connector terminal 1 is provided with an electrical connection part, a wire barrel part and an insulation barrel part in order from a tip side (mating member side).

The wire barrel part is a place that holds a conductor 50 provided in the electrical wire 5 and is electrically connected to the conductor 50 (not shown in detail).

The insulation barrel part holds an insulating layer 51 provided in the electrical wire 5 (not shown in detail).

The electrical connection part is a place that contacts the mating member and is electrically connected to the mating member.

The electrical connection part of the male terminal 2 is the strip-like tab part 20 extending on the tip side.

The electrical connection part of the female terminal 3 is at least one elastic contact part 30 (a plurality of elastic contact parts 31 and 32 in FIG. 1).

The female terminal 3 is provided with the tube part 33 into which the tab part 20 is inserted. The elastic contact part 30 is provided inside the tube part 33. The elastic contact part 30 is, typically, an elastic piece formed by a plate material being bent into an appropriate shape. Note that FIG. 1 illustrates a state where the elastic contact part 31 is subjected to a pressing force from the tab part 20 and is flattened.

In addition, parts and the like interposed between the connector terminals 1 provided at the ends of the electrical wires 5 are given as the connector terminal 1 of the embodiment. This connector terminal 1 is provided with a place for connecting with a mating member at each end. For example, the place for connecting with a mating member at each end has a structure that includes a main body part having an opening and an elastic contact piece provided inside the main body part. This structure is analogous to the electrical connection part of the above-mentioned female terminal 3. The male terminal 2 is connected as a mating member to the above main body part.

(Base Material)

The base material 100 is, typically, a molded body formed by a metal plate being bent into a predetermined final shape.

The constituent material of the base material 100 may be copper or a copper-base alloy. Copper as referred to here is so-called pure copper. Oxygen-free copper, tough pitch copper and phosphorus deoxidized copper are given as specific examples of pure copper. A copper-base alloy is an alloy containing one or a plurality of additive elements, having a Cu (copper) content of more than 50 mass %, and whose main component is copper. Additive elements include, for example, Sn (tin), P (phosphorus), Zn (zinc), Ni (nickel), Si (silicon), Fe (iron), Mg (magnesium), Be (beryllium), Co (cobalt), Cr (chromium), and Mn (manganese). The additive element content (total content in the case of containing a plurality of additive elements) is, for example, from 0.1 mass % or more to less than 50 mass %. Phosphor bronze, brass and Colson alloy are given as specific examples of a copper-base alloy. In addition, a known copper-base alloy can be utilized as the constituent material of the base material 100.

The metal plate constituting the base material 100 has a thickness from 0.1 mm to 10 mm inclusive, for example. In addition, a metal plate of known shape and size can be utilized for the base material 100.

(Covering Layer)

<Summary>

The covering layer 10 is provided on at least the surface of the electrical connection part, out of the surface of the base material 100. For example, the male terminal 2 is provided with the covering layer 10 in a place opposing the elastic contact part 30, in the tab part 20. The female terminal 3 is provided with the covering layer 10 in a place opposing the tab part 20, in the elastic contact part 30. The covering layer 10 provided on the electrical connection part contributes to reducing the connection resistance between the connector terminal 1 and the mating member.

<Structure>

The covering layer 10 includes the layer whose main component is Ag. A monolayer structure whose main component is Ag is given as an example of the covering layer 10. A multilayer structure in which a layer whose main component is Ag is the outermost layer 11, as shown in FIG. 2, is given as another example of the covering layer 10. In the case where the covering layer 10 is a multilayer structure, the covering layer 10 is provided with an intermediate layer 12 between the base material 100 and the outermost layer 11. A monolayer structure, as shown in FIG. 2, it is given as an example of the intermediate layer 12. A multilayer structure (not shown) is given as another example of the intermediate layer 12. Also, the covering layer 10 is, typically, a plating layer formed by a plating method.

<Composition>

<<Outermost Layer>>

The constituent material of the outermost layer 11 is given as a silver-based material containing 98 mass % or more of Ag, taking the above constituent material as 100 mass %. With this silver-based material, the Ag content (purity) can be said to be high. The connector terminal 1 provided with such an outermost layer 11 made of a silver-based material achieves the following effects.

(1) The electrical resistivity of Ag is low compared with copper or a copper-base alloy, for example. The connector terminal 1 is able to maintain a low resistance connection state, due to such an outermost layer 11 whose main component is Ag.

(2) The melting point of Ag is high compared with Sn (tin), for example. Thus, Ag is not susceptible to heat denaturation, even if the connector terminal 1 (particularly base material 100) reaches a high temperature during use. Accordingly, the connector terminal 1 is able to maintain a low resistance connection state, due to the outermost layer 11 whose main component is Ag. Such a connector terminal 1 can be favorably utilized in use applications in which a high temperature can be reached during use, such as a use application in which the use current value is high, for example.

(3) The thermal conductivity of Ag is high compared with copper or a copper-base alloy, for example. Such an outermost layer 11 whose main component is Ag has excellent heat dissipation, even in use applications where a high temperature can be reached as described above.

(4) Ag has excellent corrosion resistance compared with copper or a copper-base alloy, for example. Thus, in the outermost layer 11, electrical resistance can be prevented from increasing due to Ag oxidizing. Accordingly, the outermost layer 11 is able to maintain the state of containing high purity Ag. As a result, the connector terminal 1 is able to maintain a low resistance connection state, due to the outermost layer 11 whose main component is Ag.

The silver-based material, typically, contains 98 mass % or more of Ag, with the remainder consisting of impurities. The impurities are elements (e.g., C (carbon), Se (selenium), Sb (antimony), N (nitrogen), etc.) originating in raw materials used in the manufacturing process of the outermost layer 11, and other unavoidable impurities. The total content of impurities is 2 mass % or less.

There is a tendency for the above-mentioned effects (1) to (4) to become easier to obtain, as the Ag content in the silver-based material increases. Thus, the above content is preferably 98.5 mass % or more, and more preferably 99.0 mass % or more. The composition of the silver-based material may be adjusted depending on the composition of raw materials that are used in the outermost layer 11.

<<Intermediate Layer>>

The constituent material of the intermediate layer 12 can be selected as appropriate. For example, in the case where the constituent material of the base material 100 is copper or a copper-base alloy, the intermediate layer 12 includes a layer made of nickel or a nickel-base alloy. The layer whose main component is nickel has a function of preventing the copper component contained in the base material 100 from diffusing into the outermost layer 11. Due to preventing the copper component from diffusing, the copper component present particularly on the surface side of the outermost layer 11 oxidizes, and the connection resistance can be prevented from increasing due to this oxide. Accordingly, the connector terminal 1 provided with the intermediate layer 12 whose main component is Ni on the base material 100 whose main component is Cu and the outermost layer 11 whose main component is Ag on the intermediate layer 12 is able to favorably maintain a low resistance connection state, due to the outermost layer 11.

Nickel as referred to here is so-called pure nickel. A nickel-base alloy is an alloy containing one or a plurality of additive elements, having an Ni content of more than 50 mass %, and whose main component is Ni. Additive elements include, for example, P, Cr, Co, W (tungsten), S (sulfur), B (boron), Cl (chlorine), C and N. The content of additive elements (total content in the case of containing a plurality of additive elements) is, for example, from 0.1 mass % or more to less than 50 mass %.

<Vickers Hardness>

The Vickers hardness of the outermost layer 11 is from 115 HV to 160 HV inclusive, with the measuring load set to 0.1 N. If the Vickers hardness of the outermost layer 11 is in the above-mentioned specific range, the outermost layer 11 is not susceptible to being worn away and eliminated, that is, is not susceptible to wear, even if the connector terminal 1 is subjected to the following repeated sliding. The above repeated sliding is an action such as repeatedly moving a comparatively short distance, in a state where a comparatively large load is applied to the connector terminal 1. Quantitatively, the contact load is given as about 5 N and the slide distance is given as about 0.2 mm (refer to Conditions section under Slide Characteristics below). The above repeated sliding conceivably occurs in the case of being subjected to repeated vibration, for example, in a state where there is a minute gap in the connection place between the connector terminal 1 and the mating member due to manufacturing tolerance and the like. Repeated vibration occurs in the case where the connector terminal 1 is an in-vehicle component, for example. Since the outermost layer 11 is not susceptible to wear even if subjected to repeated vibration by a car, the connector terminal 1 of the embodiment can be favorably utilized as an in-vehicle component.

Here, with respect to a plated terminal provided with a silver plating layer, it was thought that as the hardness of the silver plating layer increases, wear resistance improves, that is, the silver plating layer becomes less susceptible to wear, even if a sliding action is carried out. However, the sliding action as referred to here involves the terminals being disconnected for maintenance or the like and then reconnected. This sliding action can be said to be a one-off action with a comparatively long slide distance. In contrast, the inventors of the present invention found that, with respect to an action involving repeatedly sliding a comparatively short slide distance, a layer whose main component is Ag tends to be long lasting when the Vickers hardness satisfies the above-mentioned specific range, compared with the case where the hardness is higher than this range. Based on this finding, the Vickers hardness of the outermost layer 11 is set in the above-mentioned specific range.

The Vickers hardness of the outermost layer 11 is preferably from 120 HV to 158 HV inclusive, and more preferably from 125 HV to 155 HV inclusive. In this case, the outermost layer 11 is not susceptible to wear, even if subjected to the repeated sliding described above. A method of adjusting the Vickers hardness of the outermost layer 11 will be described later.

The measuring load of the Vickers hardness is set to 0.1 N for the following reasons. In the case where a thickness $t_1$ of the outermost layer 11 is small at 20 μm or less, even smaller at 15 μm or less, or particularly small at less than 10 μm, for example, the measurement result tends to be affected by the intermediate layer 12 and the base material 100 that are located under the outermost layer 11 when the above measuring load is too large (e.g., 0.3 N or more). For example, in the case where an intermediate layer 12 made of nickel is provided directly under the outermost layer 11, Ni has a higher hardness than Ag. In this case, when the above measuring load is too large, the Vickers hardness of the outermost layer 11 tends to increase. On the other hand, when the above measuring load is too small, the Vickers hardness of the outermost layer 11 is difficult to measure appropriately due to the influence of surface coarseness and the like. If the above measuring load is 0.1 N, it is thought that the above-mentioned influences are less likely to be exerted, even if the thickness $t_1$ of the outermost layer 11 is small as described above.

<Slide Characteristics>

The connector terminal 1 of the embodiment satisfies at least one of the following characteristics (1) to (5), for example, in the case where 100 cycles of a repeated slide test are performed under the following conditions and the coefficient of friction of each cycle is measured. The coefficient of friction as referred to here is the coefficient of dynamic friction. The following conditions can be said to be conditions in which sliding a comparatively short distance occurs repeatedly, in a state where a comparatively large load is applied to the connector terminal 1.

<<Conditions>>

One cycle involves a reciprocating slide in which a test piece is caused to slide the following slide distance in one direction, and then the test piece is caused to slide the above slide distance, returning in the opposite direction. The conditions for one cycle were a contact load of 5 N, a slide distance of 0.2 mm, and a slide speed of 0.4 mm/sec.

The test pieces were produced by being cut from the connector terminal 1. The mating member that was prepared had a base material and an outermost layer that was made of a silver-based material containing 98 mass % or more of Ag, similarly to the connector terminal 1. In particular, the difference between the Vickers hardness of the outermost layer 11 of the connector terminal 1 and the Vickers hardness of the outermost layer of the mating member is preferably small. The above difference is preferably less than 10 HV. More preferably, there is substantively no difference, that is, the Vickers hardness of the outermost layer 11 of the connector terminal 1 and the Vickers hardness of the outermost layer of the mating member are substantively equal.

<<Characteristics>>

(1) An average value $y_a$ of the coefficient of friction of the cycles from 90 to 100 cycles is 1.5 or more.

(2) A ratio $y_a/x$ of the average value $y_a$ of the coefficient of friction from 90 cycles to 100 cycles to the maximum value x of the coefficient of friction is 0.7 or more.

(3) A coefficient of friction $y_{100}$ of the 100th cycle is 1.5 or more.

(4) A ratio $y_{100}/x$ of the coefficient of friction $y_{100}$ of 100th cycle to the maximum value x of the coefficient of friction is 0.7 or more.

(5) A difference (x−y) between the maximum value x of the coefficient of friction and the average value y of the coefficient of friction for 100 cycles is 0.5 or less.

<<Characteristic (1)>>

A connector terminal 1 that satisfies the characteristic (1) can be said to stably have a high coefficient of friction of 1.5 or more in the late cycles which are from 90 cycles to 100 cycles. This coefficient of friction is thought to be a value based on Ag. Thus, it can be said that an outermost layer 11 whose main component is Ag is present, even in the late cycles. With such a connector terminal 1, it can be said that the outermost layer 11 is not susceptible to wear even if subjected to repeated sliding such as described above.

In the case where the characteristic (1) is satisfied, the outermost layer 11 can be said to become less susceptible to wear even if subjected to repeated sliding such as described above, as the average value $y_a$ of the coefficient of friction increases. Thus, the above average value $y_a$ is preferably 1.60 or more, and more preferably 1.65 or more or 1.70 or more. The above average value $y_a$ is dependent on the coefficient of friction of the outermost layer 11. The above average value $y_a$ may be 3.0 or less, and even 2.8 or less, for example.

<<Characteristic (2)>>

The maximum value of the coefficient of friction in the above-mentioned slide test is thought to be a value that can be taken when the area of contact between Ag of the test piece and Ag of the mating member is largest. Thus, an outermost layer 11 whose main component is Ag is thought to be sufficiently present in the test piece when the coefficient of friction takes the maximum value. A connector terminal 1 that satisfies the characteristic (2) can be said to be in a state approximating when the coefficient of friction takes the maximum value, even in the late cycles. That is, an outermost layer 11 whose main component is Ag is present. In such a connector terminal 1, it can be said that the outermost layer 11 is not susceptible to wear even if subjected to repeated sliding such as described above.

In the case where the characteristic (2) is satisfied, the outermost layer 11 can be said to become less susceptible to wear even if subjected to repeated sliding such as described above, as the ratio $y_a/x$ of the average value $y_a$ of the coefficient of friction to the maximum value x of the coefficient increases. Thus, the above ratio $y_a/x$ is preferably 0.71 or more, and more preferably 0.72 or more. The above ratio $y_a/x$ is not more than 1.

<<Characteristic (3)>>

A connector terminal 1 that satisfies the characteristic (3) can be said to have a high coefficient of friction of 1.5 or more in the 100th cycle. This coefficient of friction is thought to be a value based on Ag as mentioned above. Thus, an outermost layer 11 whose main component is Ag can be said to be present, even in the 100th cycle. With such a connector terminal 1, it can be said that the outermost layer 11 is not susceptible to wear even if subjected to repeated sliding such as described above.

In the case where the characteristic (3) is satisfied, it can be said that the outermost layer 11 is not susceptible to wear even if subjected to repeated sliding such as described above, as the coefficient of friction $y_{100}$ of the 100th cycle increases. Thus, the above coefficient of friction $y_{100}$ is preferably 1.60 or more, and more preferably 1.65 or more or 1.70 or more. The above coefficient of friction $y_{100}$ may be 3.0 or less, and even 2.8 or less, for example.

<<Characteristic (4)>>

With regard to when the above-mentioned coefficient of friction can take the maximum value, a connector terminal 1 that satisfies the characteristic (4) can be said to be in a state approximating when the coefficient of friction takes the maximum value, even in the 100th cycle. That is, an outermost layer 11 whose main component is Ag is present. With such a connector terminal 1, it can be said that the outermost layer 11 is not susceptible to wear even if subjected to repeated sliding such as described above.

In the case where the characteristic (4) is satisfied, the outermost layer 11 can be said to become less susceptible to wear even if subjected to repeated sliding such as described above, as the ratio $y_{100}/x$ of the coefficient of friction $y_{100}$ of the 100th cycle to the maximum value x of the coefficient of friction increases. Thus, the above ratio $y_{100}/x$ is preferably 0.705 or more, and more preferably 0.710 or more. The ratio $y_{100}/x$ is not more than 1.

<<Characteristic (5)>>

With regard to when the above-mentioned coefficient of friction can take the maximum value, a connector terminal 1 that satisfies the characteristic (5) can be said to be in a state approximating when the coefficient of friction takes the maximum value from the early cycles to the late cycles. That is, an outermost layer 11 whose main component is Ag is present. With such a connector terminal 1, it can be said that the outermost layer 11 is not susceptible to wear even if subjected to repeated sliding such as described above.

In the case where the characteristic (5) is satisfied, the outermost layer 11 can be said to become less susceptible to wear even if subjected to repeated sliding such as described above, as the difference (x−y) between the maximum value x of the coefficient of friction and the average value y of the coefficient of friction decreases. Thus, the above difference (x−y) is preferably 0.44 or less, and more preferably 0.43 or less. The above difference (x−y) is not less than zero.

A connector terminal 1 that satisfies at least one of the characteristics (1) to (5) can be favorably utilized in a use application in which repeated sliding such as described above occurs, such as an in-vehicle component, for example. Even in this case, the connector terminal 1 has the outermost layer 11 for an extended period, and is able to maintain a low resistance connection state.

<Thickness>

The thickness $t_1$ of the outermost layer 11 is from 1 μm or more to less than 10 μm, for example. An outermost layer 11 whose Vickers hardness satisfies the above-mentioned specific range and whose thickness $t_1$ is 1 μm or more is not susceptible to wear, even if the outermost layer 11 is subjected to the above-mentioned repeated sliding. The outermost layer 11 tends to be present for a longer period as the thickness $t_1$ increases. As a result, the low resistance contact state due to the outermost layer 11 is readily maintained. As such, the thickness $t_1$ may be 2 μm or more, and even 3 μm or more.

If the thickness $t_1$ of the outermost layer 11 is less than 10 μm, the plating time tends to be shorter in the case where a plating method is utilized in formation of the outermost layer 11, for example. In this respect, manufacturability is enhanced. Also, a lesser amount of Ag, which is generally expensive, may be used. In this respect, reduced material costs and weight savings can also be achieved. As such, the thickness $t_1$ may be 9 μm or less, and even 8 μm or less. The thickness $t_1$ may be from 2 μm to 9 μm inclusive, and even from 3 μm to 8 μm inclusive.

A thickness $t_2$ of the intermediate layer 12 (total thickness in the case of a multilayer structure) is from 1 μm to 5 μm inclusive, for example. If the thickness $t_2$ is 1 μm or more, diffusion of the copper component into the outermost layer 11 can be suppressed as mentioned above can be suppressed, in the case where the constituent material of the base material 100 is copper or a copper-base alloy and the constituent material of the intermediate layer 12 is nickel or a nickel-base alloy, for example. If the thickness $t_2$ is 5 μm or less, an increase in connection resistance is unlikely, even in the case where the electrical resistivity of the constituent material of the intermediate layer 12 is higher than the electrical resistivity of Ag (e.g., nickel, nickel-base alloy). In terms of connection resistance, the thickness $t_2$ of the intermediate layer 12 is preferably less than the thickness $t_1$ of the outermost layer 11. The thickness $t_2$ may be from 1.1 μm to 4.5 μm inclusive, and even from 1.2 μm to 4.0 μm inclusive.

[Manufacturing Method]

With regard to the basic manufacturing method of the connector terminal 1 of the embodiment, a known method of manufacturing plated terminals can be referred to. For example, the connector terminal 1 is manufactured by the following first manufacturing method or second manufacturing method.

(First Manufacturing Method)

The first manufacturing method is a method for forming a silver layer containing 98 mass % or more of Ag on a material to be formed into the final shape. The above material is, for example, a metal plate, a plate piece obtained by punching a metal plate into a predetermined shape, or an intermediate molded body obtained by machining a plate piece into a predetermined shape. The above silver layer need only be formed so as to ultimately be an outermost layer 11 whose Vickers hardness satisfies the above-mentioned specific range.

(Second Manufacturing Method)

The second manufacturing method is a method for forming an outermost layer 11 containing 98 mass % or more of Ag and whose Vickers hardness satisfies the above-mentioned specific range on a base material 100 formed into the final shape.

Hereinafter, the manufacturing method of the outermost layer 11 will be described in detail. With regard to the method of manufacturing the material, a known method of manufacturing a metal plate need only be referred to. Similarly, with regard to the conditions and the like for forming the base material 100 from a metal plate, known conditions need only be referred to.

(Manufacture of Outermost Layer)

As the method of manufacturing the outermost layer 11, the following first film forming method or second film forming method may be used, for example.

<First Film Forming Method>

The first film forming method is a method for adjusting the Vickers hardness through heat treatment, after forming a high hardness silver layer. With the first film forming method, first, a silver layer containing 98 mass % or more of Ag and whose Vickers hardness exceeds 160 HV is formed. Thereafter, heat treatment is performed for an appropriate period, and the Vickers hardness of the silver layer is adjusted to from 115 HV and 160 HV inclusive.

In the first manufacturing method, after forming the above high hardness silver layer on the material, the above heat treatment is performed until the final shape is formed. In the second manufacturing method, after forming the above high hardness silver layer on the base material 100, heat treatment is subsequently performed.

In the formation of a silver layer whose Vickers hardness exceeds 160 HV, a plating method is utilized, for example. For example, the high hardness silver plating layer is formed by an electroplating method, utilizing a known plating solution and plating conditions.

The heat treatment conditions are as follows, for example.

The heating temperature is a temperature selected from 50° C. to 300° C. inclusive.

The Holding time is time selected from 1 hour to 200 hours inclusive.

The Vickers hardness tends to decrease as the heating temperature increases in the above-mentioned range, even if the holding time is short. Thus, increasing the heating temperature contributes to improving the manufacturability of an outermost layer 11 whose Vickers hardness is from 115 HV to 160 HV inclusive. As such, the heating temperature may be 60° C. or more, and even 80° C. or more, for example.

Oxidization and the like of the material and the base material 100 caused by this heat treatment is more easily prevented as the heating temperature decreases in the above-mentioned range. As such, the heating temperature may be 250° C. or less, and even 200° C. or less, for example. The holding time can be increased (e.g., 100 hours or more), in the case of lowering the heating temperature.

<Second Film Forming Method>

The second film forming method is a method for forming a silver layer whose Vickers hardness is from 115 HV to 160 HV inclusive, by adjusting the composition of the raw materials of the outermost layer 11, the conditions at the time of film formation, and the like. For example, in the case of utilizing an electroplating method, the composition of the plating solution and the plating conditions (solution temperature, current density, etc.) are adjusted. The composition of the plating solution includes, for example, silver potassium cyanide, potassium cyanide, or the like.

(Primary Operation and Effect)

The connector terminal 1 of the embodiment is provided with an outermost layer 11 whose main component is Ag and whose Vickers hardness is from 115 HV to 160 HV inclusive. Such an outermost layer 11 is not susceptible to wear and is favorably present, even in the case where the connector terminal 1 is subjected to repeated sliding that involves repeatedly sliding a comparatively short distance, in a state where a comparatively large load is applied to the connector terminal 1. This effect will be specifically described with a test example 1 discussed later.

For example, a structure in which the male terminal 2 consisting of the connector terminal 1 of the embodiment is connected to the female terminal 3 consisting of the connector terminal 1 of the embodiment as shown in FIG. 1 is able to maintain a low resistance connection state for an extended period. This is because Ag constituting at least one of the outermost layers 11 is present between the base material 100 of the male terminal 2 and the base material 100 of the female terminal 3, even if subjected to the repeated sliding described above.

[Electrical Wire with Terminal]

Next, an electrical wire 6 with terminal of the embodiment will be described, with reference to FIG. 1.

The electrical wire 6 with terminal of the embodiment is provided with the connector terminal 1 of the embodiment and the electrical wire 5 to which the connector terminal 1 is attached. FIG. 1 shows, on the left side of the page, the electrical wire 6 with terminal provided with the male terminal 2 as the connector terminal 1. Also, FIG. 1 shows, on the right side of the page, the electrical wire 6 with terminal provided with the female terminal 3 as the connector terminal 1.

The details of the connector terminal 1 are as described above. Hereinafter, the electrical wire 5 will be briefly described.

(Electrical Wire)

The electrical wire 5 is provided with the conductor 50 and an insulating layer 51.

The conductor 50 is constituted by a wire material made of a metal that has excellent conductivity. The above metal is, for example, copper, a copper-base alloy, aluminum, or an aluminum-base alloy. The above wire material is a single wire, a stranded wire (may be compressed stranded wire), or the like. The cross-sectional area of the conductor 50 can be selected as appropriate according to the use application.

The insulating layer 51 is a covering provided on the outer circumference of the conductor 50, and is constituted by an insulating material. The above insulating material is a type of resin composite or the like. The thickness of the insulating layer 51 can be selected as appropriate in a range satisfying a predetermined insulating property.

In addition, a known electrical wire can be utilized as appropriate for the electrical wire 5. With regard to the method of manufacturing the electrical wire 5, a known manufacturing method may be referred to. Also, the electrical wire 6 with terminal can be manufactured by attaching the connector terminal 1 to an end of the electrical wire 5.

Note that FIG. 1 illustrates the case where one connector terminal 1 is provided for every electrical wire 5, but one connector terminal 1 may be provided for a plurality of electrical wires 5. In this case, the connector terminal 1, typically, has a plurality of electrical connection parts.

(Primary Operation and Effect)

The electrical wire 6 with terminal of the embodiment is provided with the connector terminal 1 of the above-mentioned embodiment. Thus, the outermost layer 11 is not susceptible to wear, even in the case where the connector terminal 1 is subjected to the above-mentioned repeated sliding. For example, a structure in which the male terminal 2 provided on the electrical wire 6 with terminal of the embodiment is connected to the female terminal 3 provided on the electrical wire 6 with terminal of the embodiment as shown in FIG. 1 is able to maintain a low resistance connection state for an extended period. This is because Ag constituting at least one of the outermost layers 11 is interposed between the base material 100 of the male terminal 2 and the base material 100 of the female terminal 3, even if subjected to the repeated sliding described above.

[Terminal Pair]

Next, a terminal pair 4 of the embodiment will be described, with reference to FIG. 1.

The terminal pair 4 of the embodiment is provided with the male terminal 2 and the female terminal 3. At least one of the male terminal 2 and the female terminal 3 is constituted by the connector terminal 1 of the embodiment. A difference $\Delta_{HV}$ between the Vickers hardness of the outermost layer 11 in the male terminal 2 and the Vickers hardness of the outermost layer 11 in the female terminal 3 is less than 10 HV.

If the above difference $\Delta_{HV}$ is less than 10 HV, both the outermost layer 11 of the male terminal 2 and the outermost layer 11 of the female terminal 3 are not susceptible to wear, in the case of being subjected to the above-mentioned repeated sliding. It is anticipated that the outermost layer 11 will become less susceptible to wear, in the case of being subjected to the above-mentioned repeated sliding, as the difference $\Delta_{HV}$ decreases. Thus, the difference $\Delta_{HV}$ is preferably 8 HV or less, and more preferably 5 HV or less or 3 HV or less. The difference $\Delta_{HV}$ being substantively zero is even more preferable. In other words, the Vickers hardness of the outermost layer 11 of the male terminal 2 and the Vickers hardness of the outermost layer 11 of the female terminal 3 are preferably substantively equal. In the terminal pair 4 of this example, both the male terminal 2 and the female terminal 3 are constituted by the connector terminal 1 of the embodiment. Since the difference $\Delta_{HV}$ is small when the Vickers hardness of the outermost layer 11 satisfies the above-mentioned specific range for both the male terminal 2 and the female terminal 3, both outermost layers 11 are even less susceptible to wear.

(Primary Operation and Effect)

The outermost layer 11 of the male terminal 2 and the outermost layer 11 of the female terminal 3 that are provided in the terminal pair 4 of the embodiment can be said to have comparable characteristics. A structure in which the male terminal 2 and the female terminal 3 constituting such a terminal pair 4 are connected are able to maintain a low resistance connection state for an extended period. This is because Ag constituting at least one of the outermost layers 11 is present between the base material 100 of the male terminal 2 and the base material 100 of the female terminal 3, even if subjected to the repeated sliding described above.

Test Example 1

Covering members provided with silver layers having different Vickers hardnesses on the surface of a plate material made of a copper-base alloy were subjected to a repeated slide test under the following conditions, and the change in the coefficient of friction was investigated.

(Description of Test Samples)

Covering members were members modeled on the electrical connection part of the connector terminal, and were provided with the following plate material and covering layers including a silver layer.

<Base Material (Plate Material)>

The plate material was a commercially available copper-base alloy plate (product name: KLF-5) that is utilized as the material of the base material of the connector terminal. This plate material was made of a low-tin phosphor bronze-base alloy. The specific composition was Cu-2.0% Sn-0.1% Fe-0.03% P (in units of mass %). This plate material was a rectangular plate that was 40 mm wide by 25 mm long. The thickness of plate material was 0.25 mm <Covering Layer>

The covering layer was a two-layer structure provided with an intermediate layer whose main component was nickel, and a silver layer. The silver layer constituted the outermost layer of the covering member.

The intermediate layer was a nickel plating layer. The thickness of the intermediate layer was 1.7 μm. The nickel plating layer was formed by a known plating method.

The silver layer was a silver plating layer or a layer that had undergone heat treatment after plating. The silver layer of each test sample was as follows. The thickness of the silver layer of each test sample was 5.5 μm. Also, the Ag content in the silver layer of each test sample was 98 mass % or more.

The silver layer of a test sample No. 101 was a silver plating layer formed by a known plating method (bright plating). The Vickers hardness of this silver layer was 164 HV.

The silver layer of a test sample No. 102 was a silver plating layer formed by a known plating method (bright plating). The Vickers hardness of this silver layer was 111 HV.

The silver layers of test samples No. 1 to No. 3 were silver plating layers similar to the covering member of the test sample No. 101, that is, layers formed by heat treating a silver plating layer whose Vickers hardness was 164 HV.

The heat treatment conditions of the test sample No. 1 were a heating temperature of 120° C. and a holding time of 1 hour. The Vickers hardness of the silver layer after heat treatment was 150 HV.

The heat treatment conditions of the test sample No. 2 were a heating temperature of 120° C. and a holding time of 3 hour. The Vickers hardness of the silver layer after heat treatment was 136 HV.

The heat treatment conditions of the test sample No. 3 were a heating temperature of 120° C. and a holding time of 120 hour. The Vickers hardness of the silver layer after heat treatment was 126 HV.

<Measurement of Thickness, Measurement of Ag Content>

The thickness of the intermediate layer and the thickness of the silver layer of each test sample were measured as follows, using a commercially available fluorescent X-ray coating thickness gauge (here, SFT9400 series by Hitachi High-Tech Science Corporation).

In a middle position in the width direction of the covering member of each test sample, a plurality (here, seven) of measurement points were taken at equal intervals in the longitudinal direction of the covering member. At each measurement point, the thicknesses of the intermediate layer and the silver layer were measured. The thicknesses at the plurality of measurement points were respectively averaged for the intermediate layer and the silver layer. The average values were taken as the thickness of the intermediate layer and the thickness of the silver layer of the respective test samples.

The Ag content was measured by energy dispersive X-ray analysis (EDX) using a scanning electron microscope (SEM). Here, a ZEISS ULTRA 55 SEM was used. EDX analysis was implemented at an accelerating voltage of 15 kV.

<Measurement of Vickers Hardness>

The Vickers hardness of the silver layer of each test sample was measured as follows, using a commercially available micro zone test system (here, MZT-522 by Mitutoyo Corporation).

In a middle position in the longitudinal direction of the covering member of each test sample, a plurality (here, ten) of measurement points were taken at equal intervals in the width direction of the covering member. The Vickers hardness of the silver layer was measured at each measurement point. The measuring load was set to 0.1 N (≈10 gf). The Vickers hardness at the plurality of measurement point was averaged. The average values were taken as the Vickers hardness of the silver layer of the respective test samples.

<Measurement of Coefficient of Friction>

100 cycles of a repeated slide test were performed under the following conditions, using the covering member of each test sample, and the coefficient of friction was measured.

<<Test Pieces>>

The following two test pieces were produced, using the covering members of the test samples.

One test piece was an embossed piece. The other test piece was a flat piece.

The embossed piece had a hemispherical protrusion in a middle part of the covering member. A diameter R of the above protrusion was 3.0 mm. The protrusion was shaped by performing plastic processing on the covering member.

The flat piece was a test piece obtained by directly using the produced covering member, and had not undergone any special processing.

The slide test was implemented after cleaning the surface of the embossed piece and the surface of the flat piece by acetone washing.

<<Conditions of Slide Test>>

The repeated slide test was performed under the following conditions using a commercially available friction abrasion tester (here, CETR UMT-2 Tribometer by Bruker Corporation).

Contact load: 5 N

Slide speed: 0.4 mm/sec

Slide distance: 0.2 mm

Slide count: 100 times

Note that, here, the length of indentation was investigated after the slide test using a separately prepared test piece, and the slide distance and slide speed were set, such that the actual slide distance and slide speed achieved the above-mentioned values.

The flat piece and the embossed piece were made to slide, by the above-mentioned friction abrasion tester, in accordance with the above conditions of the slide test. The specific test method was as follows.

The protrusion of the embossed piece was brought in contact with the flat piece. In this contact state, the flat piece was caused to slide the above slide distance in one direction at the above slide speed. This sliding action was the outward cycle.

The flat piece, having slide the above slide distance, was caused to similarly slide in the opposite direction. This sliding action was the return cycle. This series of reciprocal sliding was one cycle.

The maximum resistance at the time of sliding was measured with the above friction abrasion tester.

The coefficient of dynamic friction was derived by dividing the measured maximum resistance by the contact load. Here, the coefficient of dynamic friction of the outward cycle and the coefficient of dynamic friction of the return cycle were derived for each cycle.

Two sets of a set consisting of the above-mentioned embossed piece and flat piece were prepared for each test sample, and respectively subjected to the above-mentioned slide test. In the following table 1, "n=1" indicates the measurement result of one set. "n=2" indicates the measurement result of the other set. "n=1, 2 average" indicates a value obtained by averaging the measurement results of the two sets. There are thus a plurality of samples.

The results of the coefficient of friction of each cycle (outward and return) are shown in the graphs of FIGS. 3 to 7 for the covering member of each test sample.

In the graphs of FIGS. 3 to 7, the horizontal axis shows the number of cycles and the vertical axis shows the coefficient of friction. The graphs of FIGS. 3 to 7 show results for the test samples No. 1, No. 2, No. 3, No. 101, and No. 102 in this order.

In the legend of the above graphs, "−1" of "No. 1-1" and "−2" of "No. 1-2" respectively indicate the measurement results of the above-mentioned "n=1" and "n=2". This similarly applies to all the test samples.

<<Characteristics>>

Here, the following five characteristics were investigated, with the results being shown in Table 1.

(1) The average value $y_a$ of the coefficient of friction (COF) from 90 cycles to 100 cycles (2) The ratio $y_a/x$ of the average value $y_a$ of the coefficient of friction from 90 cycles to 100 cycles to the maximum value x of the coefficient of friction.

(3) The coefficient of friction $y_{100}$ of the 100th cycle (4) The ratio $y_{100}/x$ of the coefficient of friction $y_{100}$ of the 100th cycle to the maximum value x of the coefficient of friction.

(5) The difference (x−y) between the maximum value x of the coefficient of friction and the average value y of the coefficient of friction for 100 cycles

TABLE 1

| | | Test Sample No. | | | | |
|---|---|---|---|---|---|---|
| | | 1 | 2 | 3 | 101 | 102 |
| | | Vickers Hardness HV (Measuring Load 0.1N) | | | | |
| | | 150 | 136 | 126 | 164 | 111 |
| COF | n = 1 | 2.166 | 2.320 | 2.298 | 2.349 | 2.331 |
| Max.: x | n = 2 | 2.082 | 2.300 | 2.510 | 2.309 | 2.452 |
| | n = 1, 2 Avg. | 2.124 | 2.310 | 2.404 | 2.329 | 2.392 |
| COF | n = 1 | 1.921 | 1.979 | 1.973 | 1.322 | 1.886 |
| Avg.: y | n = 2 | 1.813 | 1.954 | 1.983 | 1.214 | 1.829 |
| | n = 1, 2 Avg. | 1.867 | 1.966 | 1.978 | 1.268 | 1.858 |
| COF | n = 1 | 0.245 | 0.341 | 0.325 | 1.027 | 0.445 |
| x-y | n = 2 | 0.269 | 0.346 | 0.527 | 1.095 | 0.623 |
| | n = 1, 2 Avg. | 0.257 | 0.344 | 0.426 | 1.061 | 0.534 |
| COF | n = 1 | 1.839 | 1.823 | 1.888 | 0.768 | 1.510 |
| 90-100 Cycle | n = 2 | 1.720 | 1.832 | 1.615 | 0.689 | 1.336 |
| Avg.: $y_a$ | n = 1, 2 Avg. | 1.780 | 1.828 | 1.751 | 0.729 | 1.423 |
| COF | n = 1 | 0.849 | 0.786 | 0.822 | 0.327 | 0.648 |
| $y_a/x$ | n = 2 | 0.826 | 0.796 | 0.643 | 0.299 | 0.545 |
| | n = 1, 2 Avg. | 0.838 | 0.791 | 0.732 | 0.313 | 0.596 |
| COF | n = 1 | 1.895 | 1.963 | 1.829 | 0.710 | 1.459 |
| 100th cycle: | n = 2 | 1.594 | 1.887 | 1.576 | 0.713 | 1.313 |
| $y_{100}$ | n = 1, 2 Avg. | 1.745 | 1.925 | 1.703 | 0.712 | 1.386 |
| COF | n = 1 | 0.875 | 0.846 | 0.796 | 0.302 | 0.626 |
| $y_{100}/x$ | n = 2 | 0.766 | 0.820 | 0.628 | 0.309 | 0.535 |
| | n = 1, 2 Avg. | 0.820 | 0.833 | 0.712 | 0.306 | 0.581 |

As shown in FIGS. 3 to 7, it is evident that, with the test samples No. 1, No. 2 and No. 3 (hereinafter, specific test sample group), the coefficient of friction of the silver layer constituting the outermost layer tends not to vary, compared with the test samples No. 101 and No. 102, even when subjected to repeated sliding under the above-mentioned Conditions of Slide Test. The silver layers of the specific test sample group have a high coefficient of friction of roughly 1.5 or more from the early cycles to the late cycles.

Here, Ag is generally a metal that readily adheres. Thus, in the case where silver layers (Ag) contact each other, the coefficient of friction at the time of sliding is large. If view of this, the silver layers of the specific test sample group can be said to be contacting each other from the early cycles to the late cycles. It can be said that the silver layers of such a specific test sample group are not susceptible to being worn down and being eliminated, that is, are not susceptible to wear, even when subjected to the above-mentioned repeated sliding.

Figure 6:
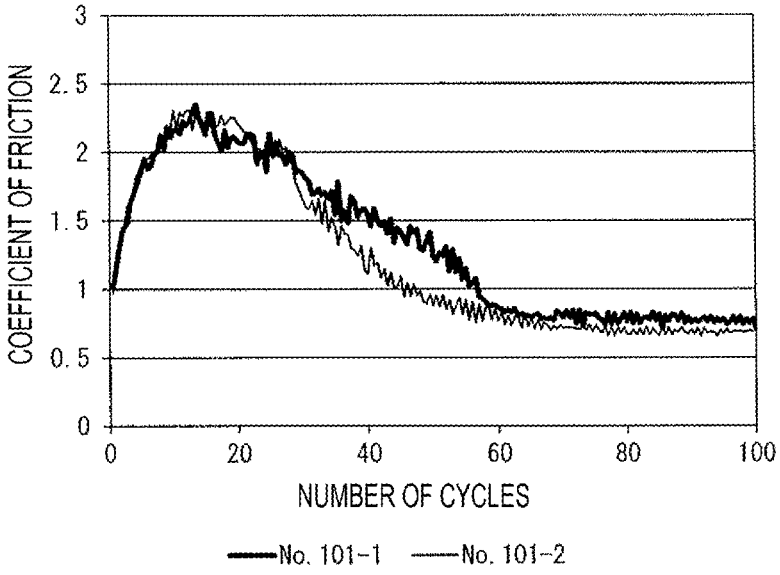
FIG. 6 is a graph showing the results of the slide test performed in the test example 1, and shows the relationship between the number of cycles and the coefficient of friction for the covering member of a test sample No. 101.

With the test sample No. 101, the coefficient of friction begins to decrease from roughly the 10th cycle as shown in FIG. 6, and the coefficient of friction is stable in a low state at roughly 60 cycles. Such a phenomenon is thought to occur for the following reasons. The silver layer of the test sample No. 101 was worn down and gradually decreases from the early cycles, and is completely eliminated in the late cycles. As a result, the nickel layer below the silver layer is exposed, and nickel layers or a nickel layer and a silver layer come in contact. Here, Ni generally does not adhere as readily as Ag. Thus, if the nickel layer is exposed in at least in one of the test pieces that slide in contact, the coefficient of friction will be low compared with contact between silver layers.

Figure 7:
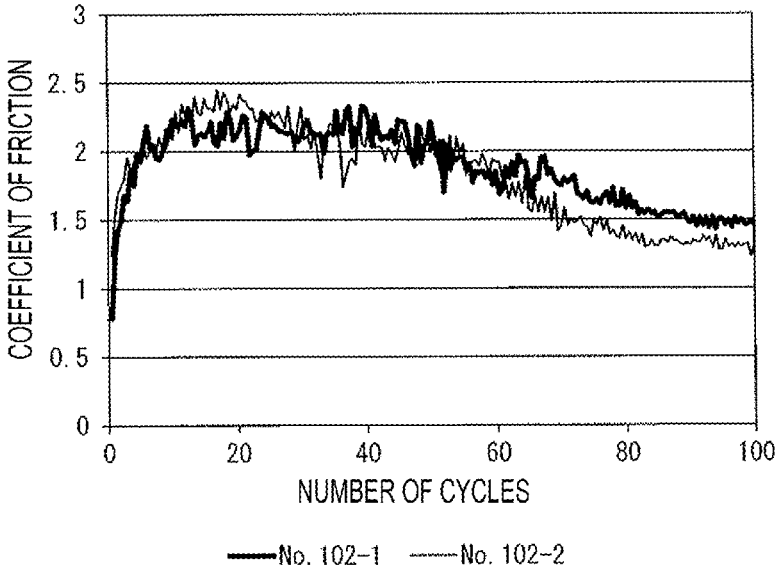
FIG. 7 is a graph showing the results of the slide test performed in the test example 1, and shows the relationship between the number of cycles and the coefficient of friction for the covering member of a test sample No. 102.

With the test sample No. 102, the coefficient of friction gradually decreases from roughly the 20th cycle as shown in FIG. 7, and is less than 1.5 in the late cycles. Such a phenomenon is thought to occur for the following reasons. The silver layer of the test sample No. 102 was worn down and gradually decreases from the early cycles. In the late cycles, there remained little of the silver layer and the nickel layer was locally exposed. Since contact between the nickel layer and the silver layer occurred, the coefficient of friction was low.

The difference in Vickers hardness between the silver layers of the specific test sample group and the silver layers of the test samples No. 101 and No. 102 is thought to be due in part to the above-mentioned difference in the wear states of the silver layers. Based on these test pieces, it can be said that the silver layers of the specific test sample group containing 98 mass % or more of Ag and whose Vickers hardness (measuring load: 0.1 N) was from more than 111 HV to less than 164 HV, and more particularly from 115 HV to 160 HV inclusive, are not susceptible to wear even in the case of being subjected to the above-mentioned repeated sliding. In this test, it can be said that the silver layer tends to be favorably present when the Vickers hardness is from 125 to 155 inclusive. In this test, it can also be said that there is little variation between the test samples of the specific test sample group, since the difference between the results of n=1 and the results of n=2 is small. It is thought that a silver layer having the above specific Vickers hardness tends to last due to at least part of Ag worn down on the outward cycle being spread and re-covering on the return cycle repeatedly, in the case of being subjected to the above repeated sliding.

A difference in crystal structure is thought to be another reason.

Figure 8:
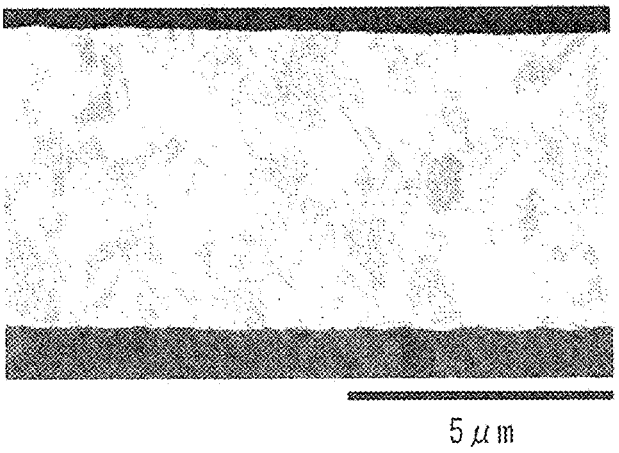
FIG. 8 is a microphotograph obtained by observing a cross-section of the covering layer of the covering member of the test sample No. 2 produced in test example 1 under a microscope.
Figure 9:
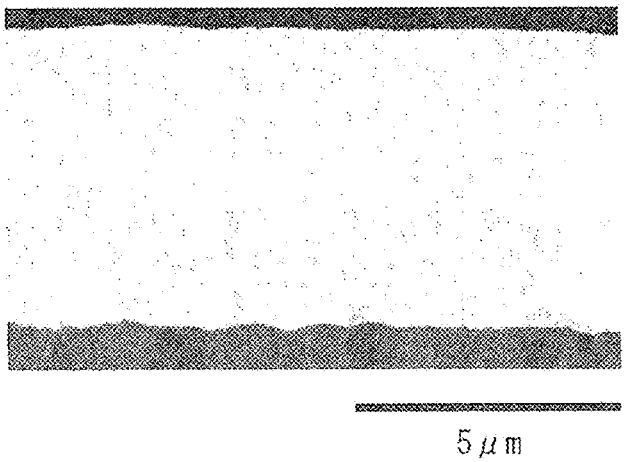
FIG. 9 is a microphotograph obtained by observing a cross-section of the covering layer of the covering member of the test sample No. 101 produced in test example 1 under a microscope.
Figure 10:
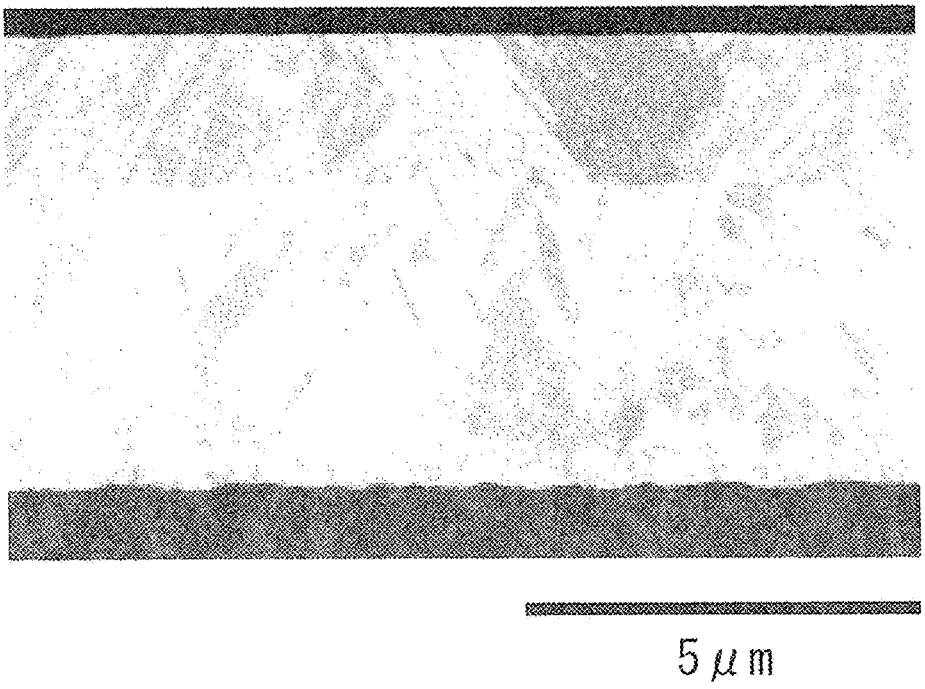
FIG. 10 is a microphotograph obtained by observing a cross-section of the covering layer of the covering member of the test sample No. 102 produced in test example 1 under a microscope.

FIGS. 8 to 10 are respectively images obtained by observing a cross-section of the covering layer of the covering members of the test samples No. 2, No. 101 and No. 102, with a scanning electron microscope (SEM). FIGS. 8 to 10 are all SEM images of cross-sections cutting the covering member in a plane parallel to the thickness direction of the covering member (lamination direction of the covering layer). FIGS. 8 to 10 show the silver layer, which is the outermost layer, and the nickel layer, which is an intermediate layer, out of the covering layers in the above cross-section. The nickel layer is partially shown. In FIGS. 8 to 10, the dark band-like region located downward on the page is the nickel layer. The gray rectangular region located in the middle on the page is the silver layer. The band-like black region located upward on the page is the background.

As shown in FIG. 9, the silver layer of the test sample No. 101, here, a silver plating layer having high hardness whose Vickers hardness exceeds 160 HV, has an extremely fine crystal structure. Based on the reduced coefficient of friction state shown in FIG. 6, it is thought that, when the fine crystal is worn down at the time of sliding, the re-adhering action tends not to occur thereafter, and that the silver plating layer is thus readily eliminated.

As shown in FIG. 10, the silver layer of the test sample No. 102, here, a silver plating layer having low hardness whose Vickers hardness is less than 115 HV, has a coarse crystal structure. Based on the reduced coefficient of friction state shown in FIG. 7, it is thought that, even though the coarse crystal grain is easily worn down, the worn down part is spread and re-adheres, and that the silver plating layer thus tends to last better than the test sample No. 101.

In contrast, as shown in FIG. 8, the silver layer of the test sample No. 2, here, a silver layer whose Vickers hardness is from 115 HV to 160 HV inclusive, has a structure constituted by a mix of coarse crystal grain and fine crystal grain. In the case where a silver layer having such a mixed fine and coarse crystal structure is subjected to the above-mentioned repeated sliding, the fine crystal is thought to suppress the wearing down of the coarse crystal to some extent. Also, the worn down coarse crystal is thought to be spread and re-cover repeatedly. Given this, it is thought that the above silver layer tends to last.

In addition, in this test, the following was evident regarding the specific test sample group. The following characteristics (1) to (5), will be basically described with the average values of n=1 and n=2.

(1) The above-mentioned average value $y_a$ of the coefficient of friction is high at 1.5 or more, and even 1.7 or more. Not only the average value but the average value $y_a$ of n=1 and average value $y_a$ of n=2 are also 1.5 or more, and even 1.6 or more.

(2) The above-mentioned ratio $y_a/x$ is high at 0.7 or more, and even 0.72 or more.

(3) The coefficient of friction $y_{100}$ of the 100th cycle is high at 1.5 or more, and even 1.7 or more. Not only the average value but the coefficient of friction $y_{100}$ of n=1 and the coefficient of friction $y_{100}$ of n=2 are also 1.5 or more, and even 1.55 or more.

(4) The above-mentioned ratio $y_{100}/x$ is high at 0.7 or more, and even 0.71 or more.

(5) Above-mentioned difference (x−y) is low at 0.5 or less, and even 0.45 or less.

The silver layers of the specific test sample group satisfying (1) above stably have a high coefficient of friction in the late cycles which are from 90 cycles to 100 cycles. Thus, the silver layer can be said to be favorably present, even in the late cycles.

The specific test sample group satisfying (2) above can be said to be in a state approximating when the coefficient of friction takes the maximum value, that is, the silver layer can be said to be favorably present, even in the late cycles.

The specific test sample group satisfying (3) above has a high coefficient of friction in the 100th cycle. Thus, the silver layer can be said to be favorably present, even in the 100th cycle.

The specific test sample group satisfying (4) above can be said to be in a state approximating when the coefficient of friction takes the maximum value, that is, the silver layer can be said to be favorably present, even in the 100th cycle.

The specific test sample group satisfying (5) above can be said to be in a state approximating when the coefficient of friction takes the maximum value, that is, the silver layer can be said to be favorably present, from the early cycles to the late cycles.

(6) In two covering members that slide against each other, the silver layers of both covering members are not susceptible to wear, even if subjected to the repeated sliding described above, when the following conditions are satisfied.

Conditions: The Vickers hardness of both silver layers is from 115 HV to 160 HV inclusive, the difference in Vickers hardness of both silver layers is 10 HV or less, and even 5 HV or less, and the Vickers hardnesses of both silver layers are preferably substantively equal.

Given this, if both silver layers satisfy the above conditions in a set of a male terminal provided with a silver layer and a female terminal provided with a silver layer, it can be said that the silver layer of the male terminal and the silver layer of the female terminal are not susceptible to wear, even if subjected to the repeated sliding described above.

The present invention is not limited to these illustrative examples and is defined by the claims, and all changes which come within the meaning and range of equivalency of the claims are intended to be embraced therein.

For example, in the test example 1, the thickness of the silver layer, the composition and thickness of the intermediate layer, and the manufacturing conditions (e.g., heat treatment conditions, plating solution, etc.) of the silver layer may be changed.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A connector terminal comprising:

a base material; and an outermost layer provided on at least part of the base material, wherein a constituent material of the outermost layer contains 98 mass % or more of Ag, a Vickers hardness of the outermost layer with a measuring load of 0.1 N is 115 HV to 160 HV inclusive, and an average value of a coefficient of friction from 90 cycles to 100 cycles is 1.5 or more, when 100 cycles of a repeated slide test are performed under conditions where a contact load is 5 N, a slide distance is 0.2 mm, and a slide speed is 0.4 mm/sec.

2. The connector terminal according to claim 1, wherein the outermost layer has a thickness from 1 μm or more to less than 10 μm.

3. The connector terminal according to claim 1, wherein the constituent material of the base material is copper or a copper-base alloy, the connector terminal comprises an intermediate layer between the base material and the outermost layer, and the intermediate layer includes a layer made of nickel or a nickel-base alloy.

4. The connector terminal according to claim 1, wherein a ratio $y_a/x$ of an average value $y_a$ of the coefficient of friction from 90 cycles to 100 cycles to a maximum value x of the coefficient of friction is 0.7 or more, when 100 cycles of the repeated slide test are performed under conditions where the contact load is 5 N, the slide distance is 0.2 mm, and the slide speed is 0.4 mm/sec.

5. The connector terminal according to claim 1, wherein the coefficient of friction of a 100th cycle is 1.5 or more, when 100 cycles of the repeated slide test are performed under conditions where the contact load is 5 N, the slide distance is 0.2 mm, and the slide speed is 0.4 mm/sec.

6. The connector terminal according to claim 1, wherein a ratio $y_{100}/x$ of a coefficient of friction $y_{100}$ of the 100th cycle to the maximum value x of the coefficient of friction is 0.7 or more, when 100 cycles of the repeated slide test are performed under conditions where the contact load is 5 N, the slide distance is 0.2 mm, and the slide speed is 0.4 mm/sec.

7. The connector terminal according to claim 1, wherein a difference (x−y) between the maximum value x of the coefficient of friction and the average value y of the coefficient of friction for 100 cycles is 0.5 or less, when 100 cycles of the repeated slide test are performed under conditions where the contact load is 5 N, the slide distance is 0.2 mm, and the slide speed is 0.4 mm/sec.

8. An electrical wire with terminal comprising:

the connector terminal according to claim 1; and an electrical wire to which the connector terminal is attached.

9. A terminal pair comprising:

a male terminal and a female terminal, wherein at least one of the male terminal and the female terminal is constituted by the connector terminal according to claim 1, and a difference between the Vickers hardness of the outermost layer in the male terminal and the Vickers hardness of the outermost layer in the female terminal is less than 10 HV.

* * * * *